US005479678A

United States Patent [19]

Reed et al.

[11] Patent Number: 5,479,678

[45] Date of Patent: Jan. 2, 1996

[54] LOCKING HINGE

[75] Inventors: David G. Reed, Langhorne; Philip Olikara, Newtown, both of Pa.

[73] Assignee: Martin Marietta Corp.

[21] Appl. No.: 393,585

[22] Filed: Feb. 21, 1995

[51] Int. Cl.[6] ..... E05F 1/08

[52] U.S. Cl. ..... 16/325; 16/303; 16/361

[58] Field of Search ..... 16/325, 280, 284, 16/283, 285, 303, 348, 350, 361, 362

[56] References Cited

U.S. PATENT DOCUMENTS

| | | | |
|---|---|---|---|
| 2,285,510 | 6/1942 | Gronberg et al. | 16/361 |
| 4,389,748 | 6/1983 | Grossman | 16/303 |
| 4,960,256 | 10/1990 | Chihara et al. | 16/361 |
| 5,393,018 | 2/1995 | Roth et al. | 16/325 |
| 5,398,378 | 3/1995 | Lin | 16/303 |

*Primary Examiner*—P. Austin Bradley
*Assistant Examiner*—Adesh Bhargava
*Attorney, Agent, or Firm*—W. H. Meise; C. A. Berard; S. A. Young

[57] ABSTRACT

A hinge includes a first clevis (30), defining a vee-block support (12) and a first limiter surface (44, 46, 48). A cylindrical hinge shaft is supported by the vee-block (12). A second clevis (140) is affixed to the shaft, whereby the second clevis may rotate in response to torques. The second clevis has a limiter surface (148) which coacts with the first limiter to limit rotation of the shaft and second clevis past the deployed state. The second clevis (140) has a cam follower (158) at a predetermined distance from the axis of rotation (2). A cam (100, 104) affixed to the first clevis (30) rotates about a cam axis (3'). The deployed-state engagement between the cam and the follower snugs one end of the shaft into the vee-block, while the rotation limiters snug the other end. A rotational driver (50, 54, 70, 75, 90, 110) urges the cam (100, 104) to rotate in a direction which tends to move the second clevis (140) from the stowed state toward the deployed state. The use of vee-blocks reduces manufacturing tolerances, and the hinge is loose, and rotates easily, from a first (stowed) state until it reaches the second (deployed) state. In the deployed state, the camming action, in conjunction with the stops, tightens the hinge pin into the vee-blocks, making a rigid structure.

4 Claims, 5 Drawing Sheets

LOCKING HINGE

FIELD OF THE INVENTION

This invention relates to hinges, and more particularly to hinges adapted for deployment of spacecraft antennas, solar panels and the like, which tend to lock in the deployed position.

BACKGROUND OF THE INVENTION

The deployment of spacecraft structures is a key part of rendering spacecraft operable for their intended purpose. The successful launching to a low orbit, separation, energization of the on-board thrusters for insertion into the proper orbit, and stabilization in the proper orbit, are of no avail if the antenna payload or the solar panels fail to deploy properly. The deployment hinge arrangement must be lightweight, reliable, and resistant to deformation after deployment, and withstand the rigors of the vacuum, high-radiation environment.

There is a substantial amount of art relating to hinges for deploying spacecraft structures. One type of prior-art hinge consists of a simple hinge, with a viscous filling between the moving parts of the hinge to provide damping. Such hinges require high machining tolerances, and may for that reason be expensive to build. Also, such hinges do not lock in any manner, and the deployed structure may be moved to a partially (or fully) stowed position due to thruster plume impingement, inertial torques, or other forces. For this reason, many prior-art hinges include latches, which operate when full deployment has been achieved. The latches themselves add to the cost and weight of the hinges, and the greater parts count tends to reduce the reliability of the hinge-latch arrangement. When the structure to be deployed is large, a plurality of hinges and latches may be required, and the concatenated reliability may be less than what is desired.

Other prior-art hinges may be simple, and provide some locking, such as that described in U.S. Pat. No. 5,196,857, issued Mar. 23, 1993 in the name of Chiappetta et al., describes a hinged antenna structure in which each hinge is made from curved elastic plates, such as graphite-epoxy plates. The cost or fabrication techniques for such structures may not be desired. Improved deployment hinges are desired.

SUMMARY OF THE INVENTION

In general, a hinge according to the invention includes a first clevis, defining a vee-block support and a first limiter surface. A cylindrical hinge shaft is supported by the vee-block. A second clevis is affixed to the shaft, whereby the second clevis may rotate in response to torques. The second clevis has a limiter surface which coacts with the first limiter to limit rotation of the shaft and second clevis past the deployed state. The second clevis has a cam follower at a predetermined distance from the axis of rotation. A cam affixed to the first clevis rotates about a cam axis. The deployed-state engagement between the cam and the follower snugs one end of the shaft into the vee-block, while the rotation limiters snug the other end. A rotational driver urges the cam to rotate in a direction which tends to move the second clevis from the stowed state toward the deployed state. The use of vee-blocks rather than precision fit bearings eliminates tight manufacturing tolerances, and the hinge is loose, and rotates easily, from a first (stowed) state until it reaches the second (deployed) state. In the deployed state, the camming action, in conjunction with the stops, tightens the hinge pin into the vee-blocks, making a rigid structure.

The hinge includes a first clevis, which defines a vee-block support and a first bottoming or limiting portion. A cylindrical (circular cross-section) shaft is supported by the vee-block. The cylindrical shaft defines a length, an axis, and also defines a diameter which results in two-line support of the shaft, whereby the axis of the cylindrical shaft represents an axis of rotation of the cylindrical shaft in the vee-block. The first bottoming portion of the first clevis is at a position which lies in a first transverse plane which is transverse to the axis of rotation of the cylindrical shaft. A second clevis is nonrotatably affixed to the cylindrical shaft, whereby the second clevis may rotate freely in the vee-block in response to torques about the axis of rotation. The cylindrical shaft may tend to be displaced from proper seating in the vee-block in response to torques applied about second and third axes, which second and third axes are mutually orthogonal to each other and to the axis of rotation. The second clevis also includes a second bottoming portion at a predetermined distance from the axis of rotation and in the first transverse plane and at a first position along the length of the cylindrical shaft which are selected to coincide with the distance from the axis of rotation and the transverse plane of the first bottoming portion, to limit the rotation of the cylindrical shaft and second clevis past the deployed state, so long as the cylindrical shaft is supported by the vee block. The second clevis further includes a cam engagement arrangement at a second predetermined distance from the axis of rotation and at a second predetermined plane transverse to the axis of rotation. A cam is affixed to the first clevis for rotation relative thereto about a cam axis. The cam engages the cam engaging arrangement of the second clevis at various engagement points. A first engagement point is at a distance from the cam axis which is substantially equal to the second predetermined distance when the hinge is in its deployed state. Another engagement point is at a distance from the cam axis which is greater than the second predetermined distance between the cam engagement arrangement and the axis of rotation when the hinge is in the stowed state. A rotational drive arrangement is coupled to the cam and to the first clevis, for urging the cam to rotate relative to the first clevis about the cam axis in a direction which tends to move the second clevis from the stowed state toward the deployed state. When the hinge is in its stowed state, and the cam begins to rotate, the distance between the cam axis and the then-current engagement point of the cam with the cam engagement arrangement is greater the distance between the cam axis and the then-current engagement point which exists when the cam nears the end of its rotation and the hinge approaches the deployed position, and the cam consequently drives or rotates the second clevis at a rate which is greater than the rotation rate when the cam is near the end of its rotation. When the cam is near the end of its rotation, which is when the hinge is nearing its deployed state, the distance, from the cam axis to the then-current engagement point between the cam and the cam engaging arrangement, becomes substantially equal to the second predetermined distance, and the cam rotates the second clevis at a rate which is less than the rotation rate at the time when the cam begins to rotate. When the cam is near the end of its rotation, the bottoming portions of the first and second clevises interact, with a resultant force which tends to maintain the cylindrical shaft in the vee block at the first transverse plane, and the cam generates a force which tends to maintain the cylindrical shaft in the vee block at the second transverse plane. The vee block may easily be made in the form of a square hole with rounded corners.

In a particular embodiment of the invention, the rotational drive arrangement includes a lever which rotates about a torque axis which is near the cam axis, and a connection arrangement is coupled to an end of the lever and to the cam at a distance from the cam axis. A torquing arrangement coupled to the lever and to the first clevis applies torque to the lever, thereby applying a torque to the cam, which drives the hinge from the stowed state toward the deployed state.

According to another embodiment of the invention, the torquing arrangement includes an auxiliary shaft with a drive portion and spring engagement arrangement. The auxiliary shaft is mounted in the first clevis for rotation about an auxiliary axis. A spring arrangement is coupled to the auxiliary shaft and to the first clevis, for applying a torque to the auxiliary shaft, which tends to rotate the auxiliary shaft. A shaft engagement arrangement associated with the lever couples the auxiliary shaft to the lever.

In another embodiment of the invention, the cam includes a first circular engagement arrangement centered on the cam axis, which engages a second circular engagement arrangement, and an eccentric mounting arrangement for mounting the first and second circular engagement arrangements with the cam axis movable relative to the auxiliary axis.

DESCRIPTION OF THE INVENTION

Figure 1A:
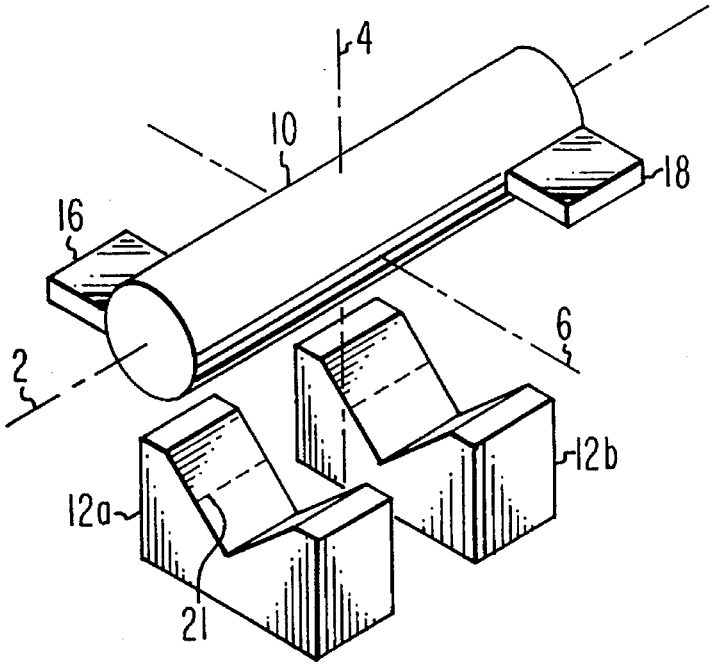
FIGS. 1*a*, and 1*b* are simplified representations a shaft and vee-blocks, and of some forces acting upon the shaft supported in the vee-blocks.
Figure 1B:
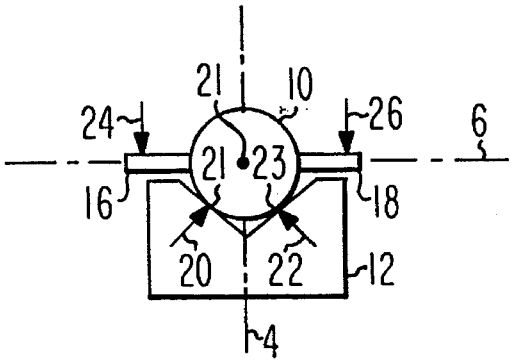

In FIGS. 1*a* and 1*b*, a cylindrical or circular cross-section shaft 10 with an axis 2, and with a first tab 16 protruding at the near end and a second tab 18 protruding at the far end, is supported by two line contacts 20, 22 in a bipartite vee-block 12*a*, 12*b*. In FIG. 1*b*, a downward force illustrated by an arrow 24 is applied to tab 16, and a downward force illustrated by an arrow 26 is applied to tab 18. Each of the forces causes a moment about axis 2, and these forces cancel. Force components illustrated as 20 and 22 act along line contacts 21 and 23 to match the net downward forces. The reaction forces applied to the bottoms of the vee-blocks to prevent translation are not illustrated. Any clockwise torques applied about the axis 2 of shaft 10 are withstood or countered by force 24, and counterclockwise forces are withstood by force 26. Torques applied about vertical axis 4, which is perpendicular to shaft axis 2, are countered by the vee-block forces 20 or 22, and tend to lift the shaft out of the vee-blocks. The lifting force is countered by forces 24 and 26 acting on tabs 16, 18. Torques acting about horizontal axis 6, orthogonal to shaft axis 2, are withstood by vee-block forces 20, 22 at one end of the shaft, and by one of the forces 24, 26 at the other end. Thus, two offset forces acting on a shaft supported by vee-blocks can stabilize the shaft against three-axis torques.

Figure 2A:
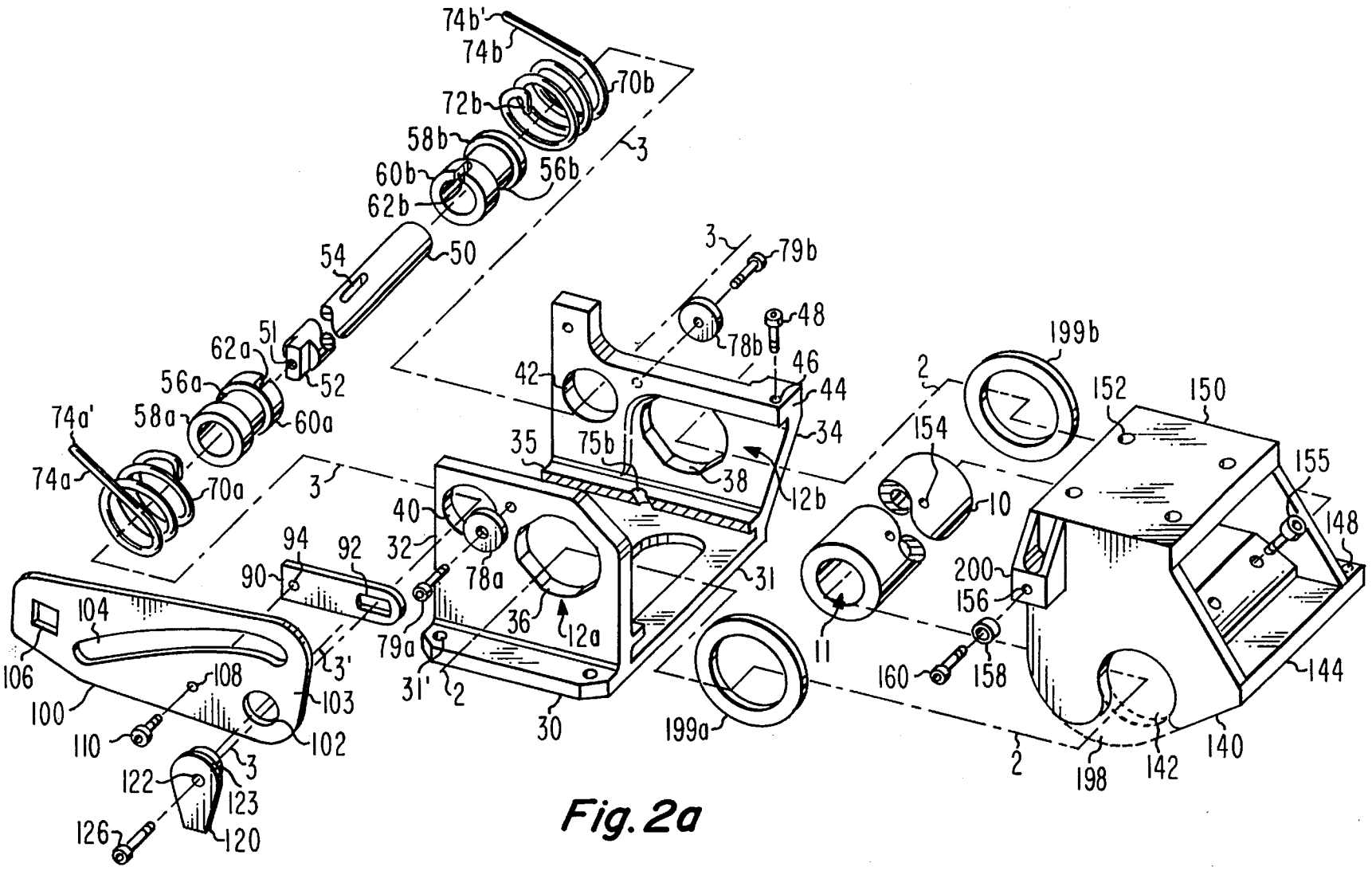
FIGS. 2*a*, 2*b*, and 2*c* are simplified, perspective or isometric, exploded, assembled undeployed, and assembled deployed views, respectively, of a hinge according to the invention.
Figure 2B:
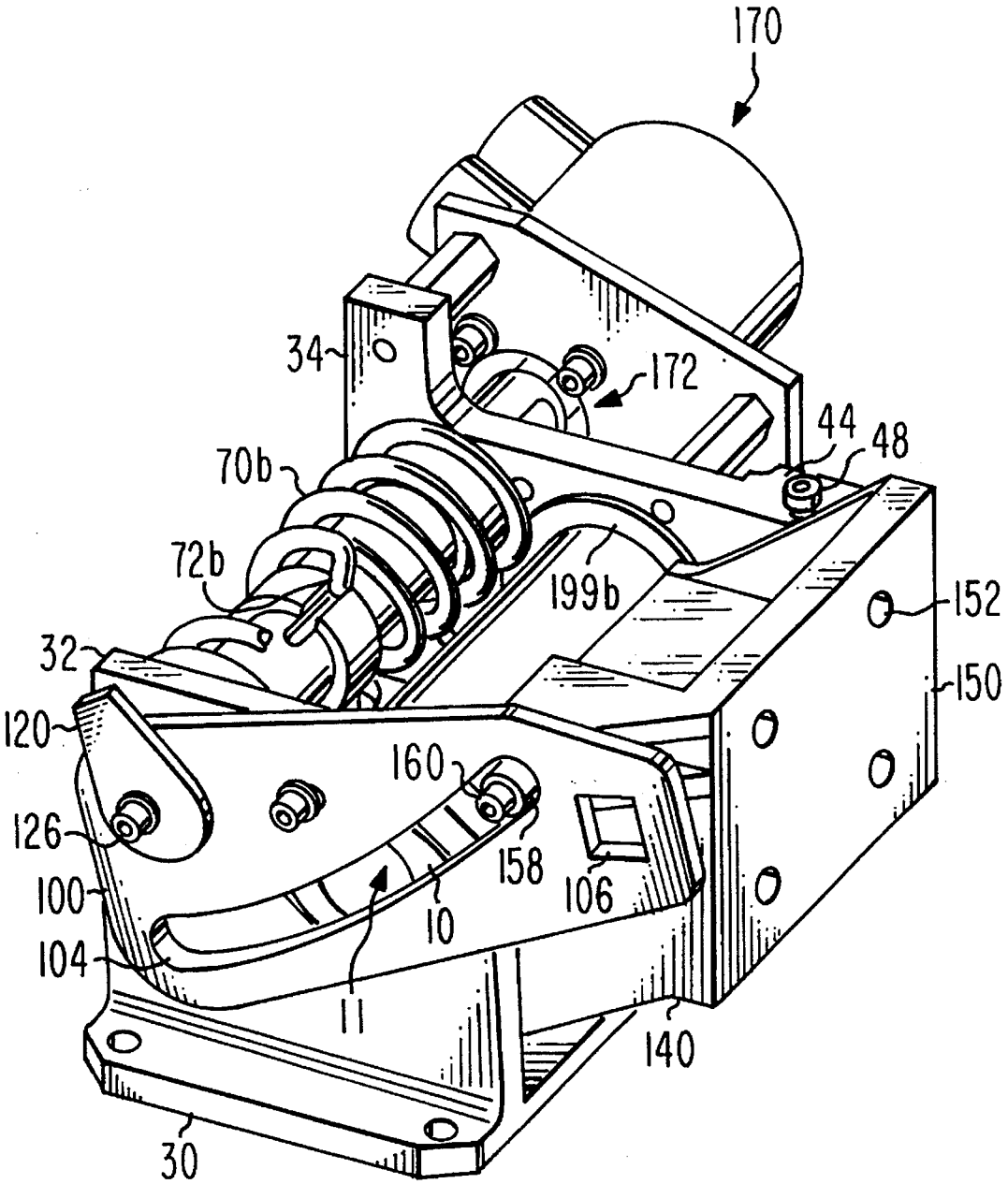
Figure 2C:
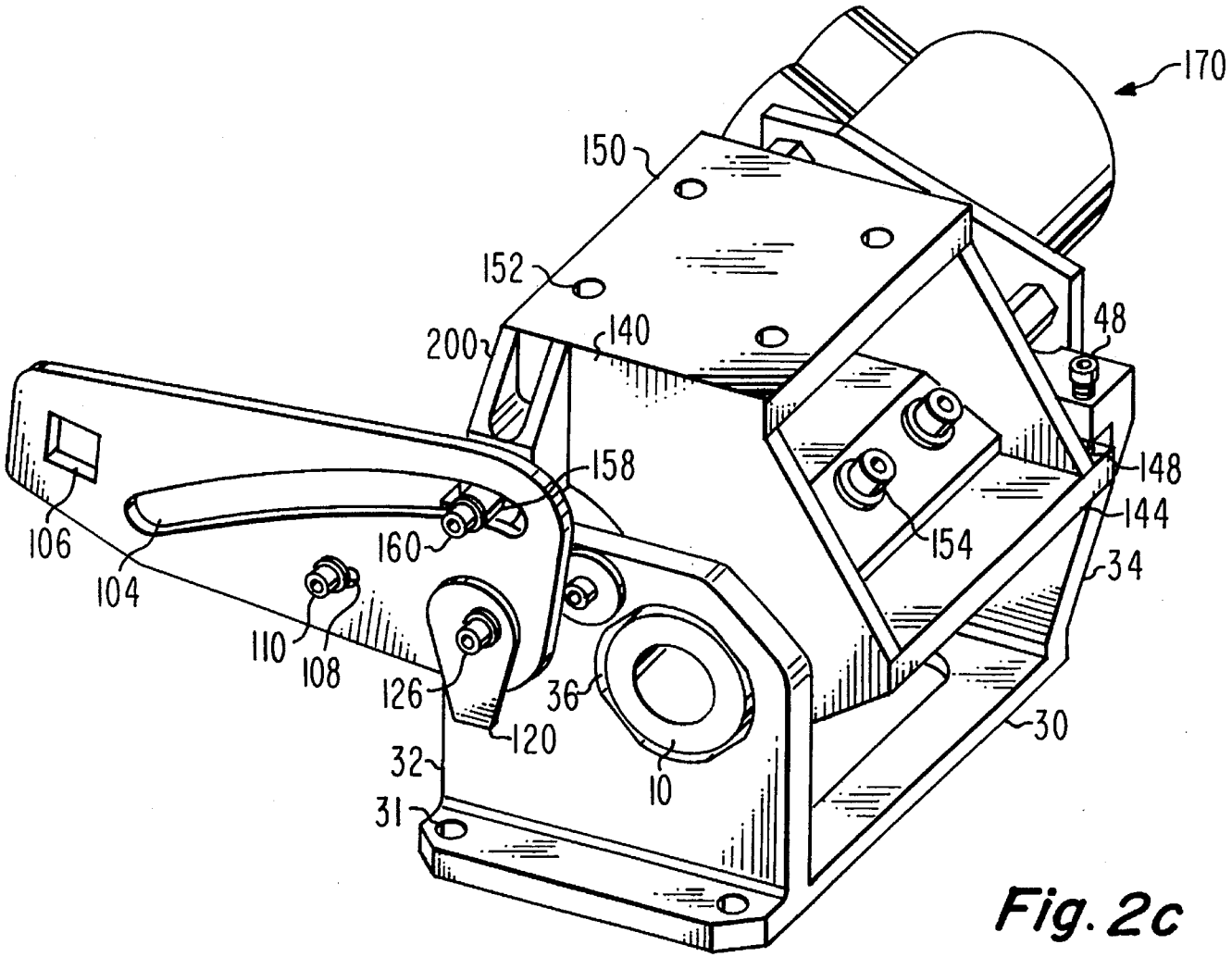

FIGS. 2*a*, 2*b*, and 2*c* illustrate a hinge according to the invention, which is adapted for 90° relative rotation between a first position (a stowed position of the associated spacecraft portions) and a second, deployed position. In FIGS. 2*a*, 2*b*, and 2*c*, elements corresponding to those of FIG. 1 are designated by like reference numerals. In FIGS. 2*a*, 2*b*, and 2*c*, cylindrical hinge shaft 10 defines a bore 11. A first clevis 30 includes a base 31, and vertical or upright portions 32 and 34. Base 31 of first clevis 30 is adapted to be connected to one of the two devices to be hinged with the aid of mounting holes, one of which is designated 31'. Hinge shaft 10 rotates in vee-blocks 12*a* and 12*b*. Vee-block 12*a* is defined by the bottom of a generally squared hole or aperture 36 defined in the upright portions 32 of first clevis 30, while vee-block 12*b* is the bottom portion of a squared-off aperture 38 defined in the upright portion 34 of clevis 30. The dimensions of apertures 36 and 38 are such that, when hinge shaft 10 is in place, the distance between flats of the apertures is about 0.010 inch greater than the hinge shaft diameter, which provides a substantial amount of play when forces tending to force the hinge shaft into the vee blocks is not present, which occurs in the stowed position, and over large portions of the travel between the stowed and deployed positions.

First clevis 30 of FIGS. 2*a*, 2*b*, and 2*c* includes a rotation stop or bottoming member in the form of a screw 48 which is threaded into, and protrudes below, an aperture 46 in a bracket portion 44 of upright or vertical member 34. The screw can be adjusted to establish the deployed position of the hinge, more readily seen in FIG. 2*c*.

A second clevis 140 includes a portion 142 curved to fit the contour of the hinge shaft, or, if optional portion 198, illustrated by dash lines, is retained, the resulting aperture 142 may be close-fitting to hinge shaft 10. Whether or not portion 198 is used, second clevis 140 is fixedly or rigidly affixed to hinge shaft 10, as by screws, one of which is illustrated as 155, threaded into apertures 154 in hinge shaft 10. Second clevis 140 defines a base 144, and a surface 150, to which a second device to be hinged may be affixed with the aid of mounting holes, one of which is designated 152. A pair of VESPEL washers 199*a*, 199*b* are placed over hinge shaft 10 and between second clevis 140 and upright portions 32, 34 of first clevis 30, to reduce friction during rotation. No retainer is needed to retain hinge shaft 10 in position, since it is fixedly attached to second clevis 140.

Second clevis 140 of FIGS. 2*a*, 2*b*, and 2*c* includes a portion 148 of base 144, which bears against screw 48 of the first clevis, and together therewith establishes the limit of hinge rotation in the deployed direction. In addition, second clevis 140 includes a protruding boss 200, which defines a threaded aperture 156. A shoulder screw 160 passes through the center of a cam follower roller 158 and into aperture 156.

An auxiliary shaft 50 of FIGS. 2*a*, 2*b*, and 2*c* has an auxiliary axis 3. Auxiliary shaft 50 is mounted for rotation in mounting holes 40 and 42 in clevis portions 32 and 34, respectively. The basic purpose of auxiliary shaft 50 is to support a pair of coil springs 70*a*, 70*b*, which provide the stored energy for moving the hinge from its stowed position to its deployed position, and which, at the end of rotation, when the hinge has reached the deployed position, maintain a force tending to hold bottoming surface 148 of base 144 of second clevis 140 against limit screw 48 of the first clevis 30. This force corresponds to force 26 of FIG. 1*b*.

Coil springs 70*a* and 70*b* each include a coil having a diameter, an inwardly protruding portion 72*a* (not visible) and 72*b* (visible in FIGS. 2*a* and 2*b*), and a relatively long, outwardly-protruding portion 74*a*, 74*b*. The length of inwardly protruding portion 72*b* of coil spring 70*b* is such that the remaining clearance inside the coil spring is large enough to accommodate shaft 50. Coil spring 70*a* is similarly dimensioned. Spring 70*b* is assembled onto shaft 50 by slipping the spring onto the shaft, then placing the inwardly-protruding portion 72*b* in a slot 54 cut into the surface of shaft 50. In order to keep coil spring 70*b* centered on the shaft, a VESPEL plastic bushing 56*b* is slipped over the shaft and into the coil spring. Bushing 56*b* has collars 58*b* and 60*b*, which have diameters substantially equal to the inside diameter of coil spring 70*b*. Similarly, a bushing 56*a* includes collars 58*a*, 60*a* which diameters similar to the inside diameter of coil spring 70*a*. Bushings 56*a* and 56*b* also have notches, illustrated as 62*a* and 62*b*, which allow the bushings to be pushed into close juxtaposition on auxiliary shaft 50.

When shaft 50 is assembled into apertures 40 and 42 of first clevis 30 of FIGS. 2*a*, 2*b*, and 2*c*, the ends 74*a'* and 74*b'* of the coil springs are inserted into a pair of apertures, one of which is illustrated as 75*b*, in a shelf 35 portion of first clevis 30. This insertion requires that the coil spring be tensioned. Bushings 56*a* and 56*b* are retained in position by washers illustrated as 78*a* and 78*b*, respectively, held to upright portions 32 and 34 by screws 79*a* and 79*b*, respectively. The ends of coil springs 70*a* and 70*b* may incidentally bear against the insides of upright portions 32 and 34, but the portions of the coil springs so bearing are essentially immobile, and no significant wear occurs.

When auxiliary shaft 50 is assembled into apertures 40 and 42 of first clevis 30 of FIGS. 2*a*, 2*b*, and 2*c*, an end portion of auxiliary shaft 50, including flats 52, extends past the upright portion 32 of the clevis. This end portion both couples the spring forces to the remainder of the hinge, and provides a support for a cam. A cam plate 100, defining an elongated cam path, slot or surface 104, is supported for rotation by a circular aperture 102, which rides on a circular boss 128 extending from a cam eccentric 120. Cam eccentric 120 has a through hole 122, off-center relative to the center of boss 123. Eccentric 120 is supported by a screw 126 which passes through aperture 122, and which is threaded into an aperture 51 in the end of auxiliary shaft 50. Thus, screw 126 and aperture 120 are centered on auxiliary shaft 50, but cam plate 100 rotates about the center of its aperture 102 and circular boss 123, which are offset from the axis 3 of auxiliary shaft 50. The axis of rotation of cam plate 100 is designated 3', to distinguish it from the axis 3 of shaft 50. Since, as described below, no torques are delivered to cam plate 100 by way of eccentric 120, the frictional connection established by screw 126 extending into shaft 50 suffices for support.

Torques are applied from shaft 50 of FIGS. 2*a*, 2*b*, and 2*c* by way of flats 52 of shaft 50, which bear against a correspondingly shaped aperture 92 in a cam drive lever 90. The torques so established are communicated to the cam plate by a screw 110, which extends through an aperture 108 in cam plate 100, and which screws into a threaded aperture 94 on the cam drive lever. A square aperture 106 is provided in the end of cam plate 100, dimensioned to accept the square drive of an ordinary wrench set, so that a breaker bar or rachet drive bar can engage square hole 106, to provide the torques required to set the hinge to its stowed position against the forces of springs 70*a* and 70*b*.

Figure 3:
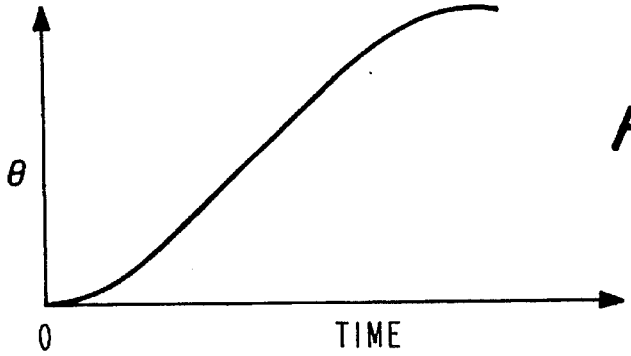
FIG. 3 is a plot of angle versus time for a hinge according to the invention.

Cam follower roller 158 of FIGS. 2*a*, 2*b*, and 2*c*, which is associated with second clevis 140, is dimensioned to fit within cam slot 104 in cam plate 100, and to bear on its surfaces. Cam slot 104 preferably has a spiral shape relative to the center of rotation, but for machining simplicity, it can be made as a series of circular slots. In an embodiment of the 90° version of the hinge, two different diameter circular slots were found to be sufficient. In the stowed position of the hinge, illustrated in FIG. 2*b*, cam follower roller 158 is at the extreme end of the cam slot 104, remote from the center of rotation of cam plate 100. The center of rotation of cam plate 100 is somewhere near screw 126. Thus, the torques tending to rotate second clevis 140 about hinge pin 10 are applied at the end of a long lever arm; this in turn means that the torque at the beginning of motion is relatively small, and the rate or velocity of motion tends to be high. In the deployed position of the hinge, illustrated in FIG. 2*c*, the torques tending to rotate second clevis 140 about hinge pin 10 are applied at the end of a relatively shorter lever arm, represented by the distance between roller 158 and screw 126; this in turn means that the torque or forces at the end of travel are relatively great, and the rate of motion is relatively small. Thus, the hinge according to the invention has the great advantage that its motion slows as it approaches the deployed position, thereby reducing the inertial forces which may occur due to deployment of large devices, and improving attitude control stability. The preferred embodiments of the invention include dampers, such as viscous damper 170 of FIGS. 2*b* and 2*c*, to further control the motion. FIG. 3 illustrates the general form of rotation angle θ versus time for a damped hinge according to the invention, including the slowing effect of the viscous damper at the beginning of motion.

Figure 4A:
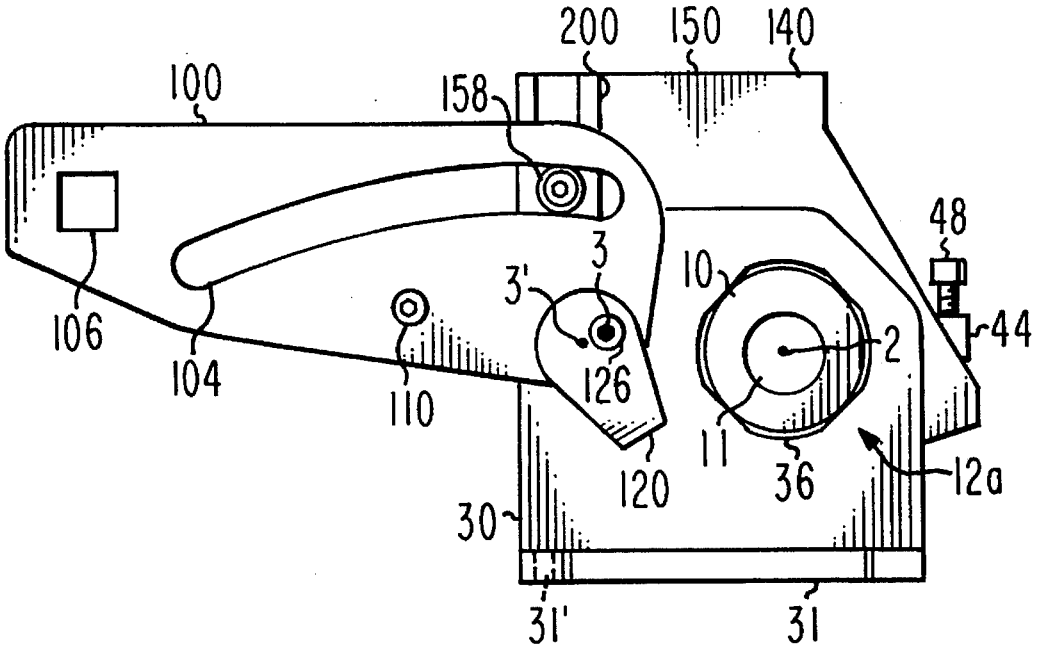
FIG. 4*a* is a simplified side view of the structure of FIGS. 2*a*, 2*b*, and 2*c* with deployed state.
Figure 4B:
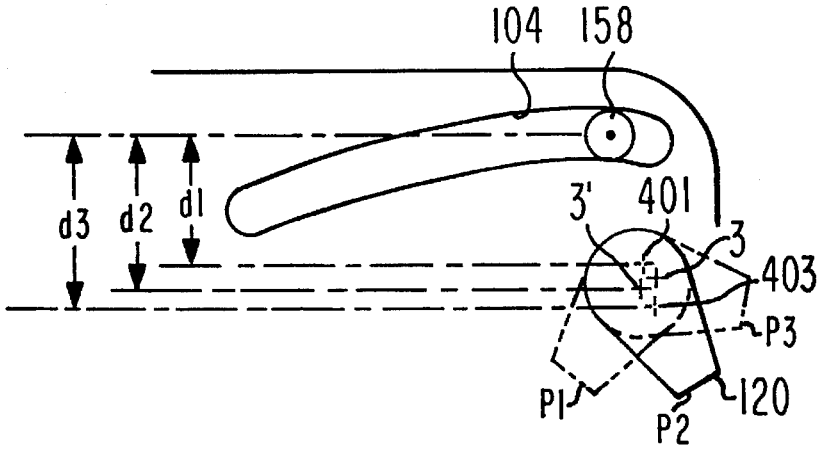
FIG. 4*b* is a simplified view of a portion thereof, illustrating dimensions.

The adjustment of the center of rotation of cam plate 100 about axis 3' allows the forces tending to hold the hinge shaft 10 into vee-block 12*a* to be controlled. FIG. 4*a* is a side view of the arrangement of FIGS. 2*a*, 2*b*, and 2*c*, in its deployed state. In FIG. 4*a*, elements corresponding to those of FIGS. 2*a*, 2*b*, and 2*c* are designated by like reference numbers. In FIG. 4*a*, counterclockwise rotation of cam plate 100 has brought second clevis 140 to its deployed state, in which counterclockwise rotation of second clevis 140 relative to first clevis 30 is stopped by interference between the end of screw 48 and a corresponding portion of second clevis 140. As a result, no further counterclockwise rotation of second clevis 140 is possible. FIG. 4*b* is a simplified view of cam follower roller 158, cam slot 104, and the position of cam plate axis 3' for three different positions P1, P2, and P3, of eccentric 120. Position P2 is the "nominal" position, and the corresponding position of cam plate axis 3' is indicated. The position of the cam plate rotation axis in eccentric position P1 is designated 401, and the position of the cam plate rotation axis in eccentric position P3 is designated 403. Dimensions d1, d2, and d3 indicate the relative distance between axes of rotation 401, 3', and 403. In particular, note that the illustrated distance can be reduced by moving eccentric 120 to position P1, and the distance can be increased by moving eccentric 120 to position P3. It should be understood that the rotation of cam plate 100 will continue, until the torque imparted by the springs equals the torque applied to the cam plate by interference between cam follower 158 and cam slot 104. Adjustment of the eccentric position, therefore, which changes the relationship between the follower and the cam surface, can result in a change in the position at which the cam stops rotating the hinge. The forces acting on cam follower 158 when the hinge is in its deployed state provide a downward force about hinge axis 2, which tends to hold hinge shaft 10 in the vee 12, much like force 24 of FIG. 1.

The same general arrangement as that described in conjunction with FIGS. 2*a*, 2*b*, and 2*c* may be used for amounts of rotation other than 90°, such as 180°, by adjusting the length of the cam to suit the swing of the cam follower, and by morphing the clevis shapes to match the structures being hinged.

Other embodiments of the invention will be apparent to those skilled in the art. For example, the described structure may be made from any material suitable for use in space and capable of bearing the loads, it may be coated or painted, and it may be lubricated. While shaft 10 has been described and illustrated as circular, only those portions of shaft 10 which engage the vee-block 12, 14 portions of apertures 36 and 38 need to be circular, other portions of the shaft, such as those portions of the shaft which include threaded apertures 154, may have an arbitrary cross-section, such as square.

What is claimed is:

1. A hinge for hinging between a first, stowed state, and a second, deployed state, said hinge comprising:

a first clevis, said first clevis defining a vee-block support and a first bottoming portion;

a cylindrical shaft supported by said vee-block, and defining a length, an axis, and also defining a diameter which results in two-line support along said shaft, whereby said axis represents an axis of rotation of said cylindrical shaft in said vee-block;

a second clevis nonrotatably affixed to said cylindrical shaft, whereby said second clevis may rotate freely in said vee-block in response to torques about said axis of rotation, but said cylindrical shaft may tend to be displaced from proper seating in said vee-block in response to torques about second and third axes, which second and third axes are mutually orthogonal to each other and to said axis of rotation, said second clevis also including a second bottoming portion at a predetermined distance from said axis of rotation and at a first predetermined plane transverse to said axis of rotation along said length of said cylindrical shaft, selected to coincide with the distance from said axis of rotation and the transverse plane of said first bottoming portion, to limit the rotation of said cylindrical shaft toward said deployed state so long as said cylindrical shaft is supported by said vee block, said second clevis further including cam engagement means at a second predetermined distance from said axis of rotation and at a second predetermined plane transverse to said axis of rotation;

a cam affixed to said first clevis for rotation relative thereto about a cam axis, said cam engaging said cam engaging means of said second clevis at engagement points, which are at distances from said cam axis which are (a) substantially equal to said second predetermined distance when said hinge is in deployed state, and (b) which are greater than said second predetermined distance when said hinge is in the stowed state; and rotational drive means coupled to said cam and to said first clevis, for urging said cam to rotate relative to said first clevis about said cam axis in a direction which tends to move said second clevis from said stowed state toward said deployed state, whereby, when said cam begins to rotate, said distance between said cam axis and said engagement point is greater than when said cam nears the end of its rotation, and rotates said second clevis at a rate which is greater than the rotation rate when said cam is near said end of its rotation, and in which said distance from said cam axis and said engagement point becomes substantially equal to said second predetermined distance when said cam nears the end of its rotation, and rotates said second clevis at a rate which is less than the rotation rate when said cam begins to rotate, and whereby, when said cam is near said end of its rotation, said bottoming portions of said first and second clevises interact, with a resultant force which tends to maintain said cylindrical shaft in said vee block at said first plane, and said cam tends to generate a force which tends to maintain said cylindrical shaft in said vee block at said second plane.

2. A hinge according to claim 1, wherein said rotational drive means comprises a lever which rotates about a torque axis which is near said cam axis:

connection means coupled to an end of said lever and to said cam at a distance from said cam axis: and torquing means coupled to said lever and to said first clevis for applying torque to said lever, thereby applying a torque to said cam.

3. A hinge according to claim 2, wherein said torquing means comprises:

a auxiliary shaft including a drive portion and spring engagement means, said auxiliary shaft being mounted in said first clevis for rotation about an auxiliary axis;

spring means coupled to said auxiliary shaft and to said first clevis, for applying a torque to said auxiliary shaft;

shaft engagement means associated with said lever, for coupling said auxiliary shaft to said lever.

4. A hinge according to claim 3, wherein said cam comprises:

a first circular engagement arrangement centered on said cam axis;

a second circular engagement arrangement dimensioned and arranged for engagement with said first circular engagement arrangement; and eccentric mounting means for mounting said first and second circular engagement arrangements with said cam axis movable relative to said auxiliary axis.

* * * * *